US007593661B2

(12) United States Patent
Watanabe et al.

(10) Patent No.: US 7,593,661 B2
(45) Date of Patent: Sep. 22, 2009

(54) POWER-SAVING CONTROL METHOD OF IMAGE FORMING DEVICE, AND IMAGE FORMING DEVICE

(75) Inventors: Yoshiaki Watanabe, Kanagawa (JP); Hiroshi Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 335 days.

(21) Appl. No.: 11/743,309

(22) Filed: May 2, 2007

(65) Prior Publication Data

US 2007/0286630 A1 Dec. 13, 2007

(30) Foreign Application Priority Data

May 15, 2006 (JP) ..... 2006-135635
Mar. 28, 2007 (JP) ..... 2007-084986

(51) Int. Cl.
*G03G 15/00* (2006.01)
*G03G 15/20* (2006.01)

(52) U.S. Cl. ..... 399/88; 399/70

(58) Field of Classification Search ..... 399/36, 399/37, 70, 82, 85, 88
See application file for complete search history.

(56) References Cited

U.S. PATENT DOCUMENTS 5,809,369 A * 9/1998 Furuya et al. ..... 399/70
6,347,202 B1 * 2/2002 Shishizuka et al. ..... 399/75
2005/0271410 A1 12/2005 Namizuka et al.

FOREIGN PATENT DOCUMENTS

JP 2002-94713 3/2002
JP 2006-262163 9/2006

OTHER PUBLICATIONS

U.S. Appl. No. 12/033,424, filed Feb. 19, 2008, Watanabe.

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

In a power-saving control method of an image forming device, the image forming device is set in a power saving state when an input operation is not performed by a user over a predetermined time. The image forming device in the power saving state is shifted to a minimum power state. Prior to shifting of the image forming device to the minimum power state, a filtering unit is activated to detect communication between an external device and the image forming device in the minimum power state. When a detected communication signal indicates an image formation request from the external device, the image forming device is caused to return from the minimum power state through the power saving state to a standby state so that the image forming device is ready for performing image formation.

12 Claims, 6 Drawing Sheets

| | STATE TRANSITION FACTOR |
|---|---|
| F1 | TIMER |
| F2 | KEY OPERATION |
| F3 | KEY OPERATION & NETWORK RESPONSE |
| F4 | INTERNAL TIMER |

POWER-SAVING CONTROL METHOD OF IMAGE FORMING DEVICE, AND IMAGE FORMING DEVICE

BACKGROUND OF THE INVENTION

1. Field of the Invention

This invention relates to a power-saving control method of an image forming device, and to the image forming device. More particularly, this invention relates to a power-saving control method of an image forming device, such as a digital copier, an analog copier, a printer or an MFP, which is provided with a power saving function, and to the image forming device.

2. Description of the Related Art

In recent years, digital multi-functional peripherals (MFP) which are capable of carrying out multiple image-forming functions, including a copy function, a facsimile function, and a print function, have been widely adopted. This image forming device performs complicated data processing with the use of a high-speed CPU and a mass recording medium, etc., and it is in the tendency that various other image-forming functions are increasingly added to the image forming device.

Moreover, as a result of performing functional development which is in conformity with the user's demand for carrying many communication facilities on the image forming device and the increase of control devices for use in a color image forming device, the tendency to increase the power consumption of the image forming device further is accelerated.

For example, Japanese Laid-Open Patent Application No. 2002-094713 discloses an image forming device which is provided with a control mechanism for performing power-saving control of the image forming device, in order to reduce the power consumption and cost of the image forming device. The power-saving control performed by this image forming device is aimed at maintaining the balance between the operability at the time of power-saving mode and the efficiency of power saving or quick response at the time of returning from the power saving mode, according to the operating condition and timing of the image forming device As mentioned above, it is in the tendency that the power consumption of the image forming device at the time of operation increases. On the other hand, the user's demand is to reduce the power consumption of the image forming device to the lowest possible level. For this reason, it is indispensable to provide an image forming device with a mechanism for reducing the power consumption of the image forming device in the standby state during which the user does not use the device, as much as possible.

The mechanism for reducing the power consumption provided in an image forming device may include a function to turn OFF the operation panel display, a control function to stop rotation of the polygon motor, a control function to lower the fixing temperature, a control function to reduce driving portions of motors of the engine unit, and a control function to suspend operation of the peripheral device, when the user's operation does not arise over a fixed time.

As for the user' operation, a timer setting for the time of shifting to the low power state in conformity with the Energy Star standard requirements, and a timer setting for the time of shifting to auto-off/sleep mode may be provided. And a user interface which enables the user to set up the power consumption function may be provided.

The depression of a power-saving shift key, the depression of a power key, and the expiration of a timer count set up by the user, etc. may be included in the shift conditions into the power saving state. The activation of a job by an application program, the depression of the power key, and a change of the device configuration in the image forming device may be included in the return conditions from the power saving state.

SUMMARY OF THE INVENTION

According to one aspect of the invention, there is provided an improved image forming device in which the above-described problems are eliminated.

According to one aspect of the invention there is provided a power-saving control method of an image forming device which can increase the power saving effect further, with the provision of a mechanism for shifting the image forming device from a power saving state in which the power supply to all function units in a main control function unit except a main control unit is stopped, to a minimum power state in which the power supply to the main control unit is further stopped, and a mechanism for detecting a return factor during the minimum power state and for returning the image forming device from the minimum power state to the power saving state upon detection of the return factor.

In an embodiment of the invention which solves or reduces one or more of the above-mentioned problems, there is provided a power-saving control method of an image forming device which is adapted for being set in a power saving state in which power supply to all function units in a main control function unit, except a main control unit which controls the whole image forming device, is stopped, the power-saving control method comprising steps of: setting the image forming device in the power saving state when an input operation is not performed by a user over a predetermined time; shifting the image forming device from the power saving state to a minimum power state in which power supply to the main control unit is stopped; activating, prior to shifting of the image forming device to the minimum power state, a filtering unit receiving a power supply separate from a power supply to the main control function unit, so that the filtering unit detects communication between an external device and the image forming device in the minimum power state; determining whether a communication signal detected by the filtering unit in the minimum power state indicates an image formation request from the external device; and causing, when the communication signal indicates the image formation request, the image forming device to return from the minimum power state through the power saving state to a standby state, so that the image forming device is ready for performing image formation.

The above-mentioned power-saving control method may be configured so that the step of shifting the image forming device includes a step of determining whether shifting of the image forming device to the minimum power state is permitted based on configuration information of the image forming device and a state of the external device connected to the image forming device.

The above-mentioned power-saving control method may be configured so that the power-saving control method further comprises a step of notifying the user of impossibility of shifting of the image forming device to the minimum power state by e-mail, when it is determined that the shifting of the image forming device is not permitted.

The above-mentioned power-saving control method may be configured so that the power-saving control method further comprises a step of displaying an alarm message, indicating that shifting of the image forming device to the minimum power state is impossible, on an operation panel of the image forming device to receive attention from the user, when it is determined that the shifting of the image forming device is not permitted.

The above-mentioned power-saving control method may be configured so that the step of shifting the image forming device includes a step of determining whether an operation setting for permitting shifting of the image forming device to the minimum power state is performed beforehand on a setting screen of an operation panel of the image forming device by the user.

The above-mentioned power-saving control method may be configured so that the step of shifting the image forming device includes a step of arbitrating transition conditions for shifting to the minimum power state by comparison with an operating state of a program of an application layer of the image forming device, and determining whether arbitration of the transition conditions is completed.

Moreover, in an embodiment of the invention which solves or reduces one or more of the above-mentioned problems, there is provided an image forming device which is adapted for being set in a power saving state in which power supply to all function units in a main control function unit, except a main control unit which controls the whole image forming device, is stopped, the image forming device comprising: a setting unit setting the image forming device in the power saving state when an input operation is not performed by a user over a predetermined time; a shifting unit shifting the image forming device in the power saving state to a minimum power state in which power supply to the main control unit is stopped; a filtering unit receiving a power supply separate from a power supply to the main control function unit, and detecting communication between an external device and the image forming device in the minimum power state; an activating unit activating, prior to shifting of the image forming device to the minimum power state, the filtering unit, so that the filtering unit detects communication between the external device and the image forming device in the minimum power state; a determining unit determining whether a communication signal detected by the filtering unit in the minimum power state indicates an image formation request from the external device; and a returning unit causing, when the communication signal indicates the image formation request, the image forming device to return from the minimum power state through the power saving state to a standby state, so that the image forming device is ready for performing image formation.

According to the embodiments of the power-saving control method and the image forming device of the invention, the image forming device is provided with a mechanism for shifting the image forming device from the power saving state in which the power supply to all function units in the main control function unit except the main control unit is stopped, to the minimum power state in which the power supply to the main control unit is further stopped, and provided with a mechanism for detecting a return factor during the minimum power state and for returning the image forming device from the minimum power state to the power saving state upon detection of the return factor. Thus, it is possible to provide the power-saving control method and the image forming device which can increase the power saving effect further.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will be given of embodiments of the invention with reference to the accompanying drawings.

Figure 1:
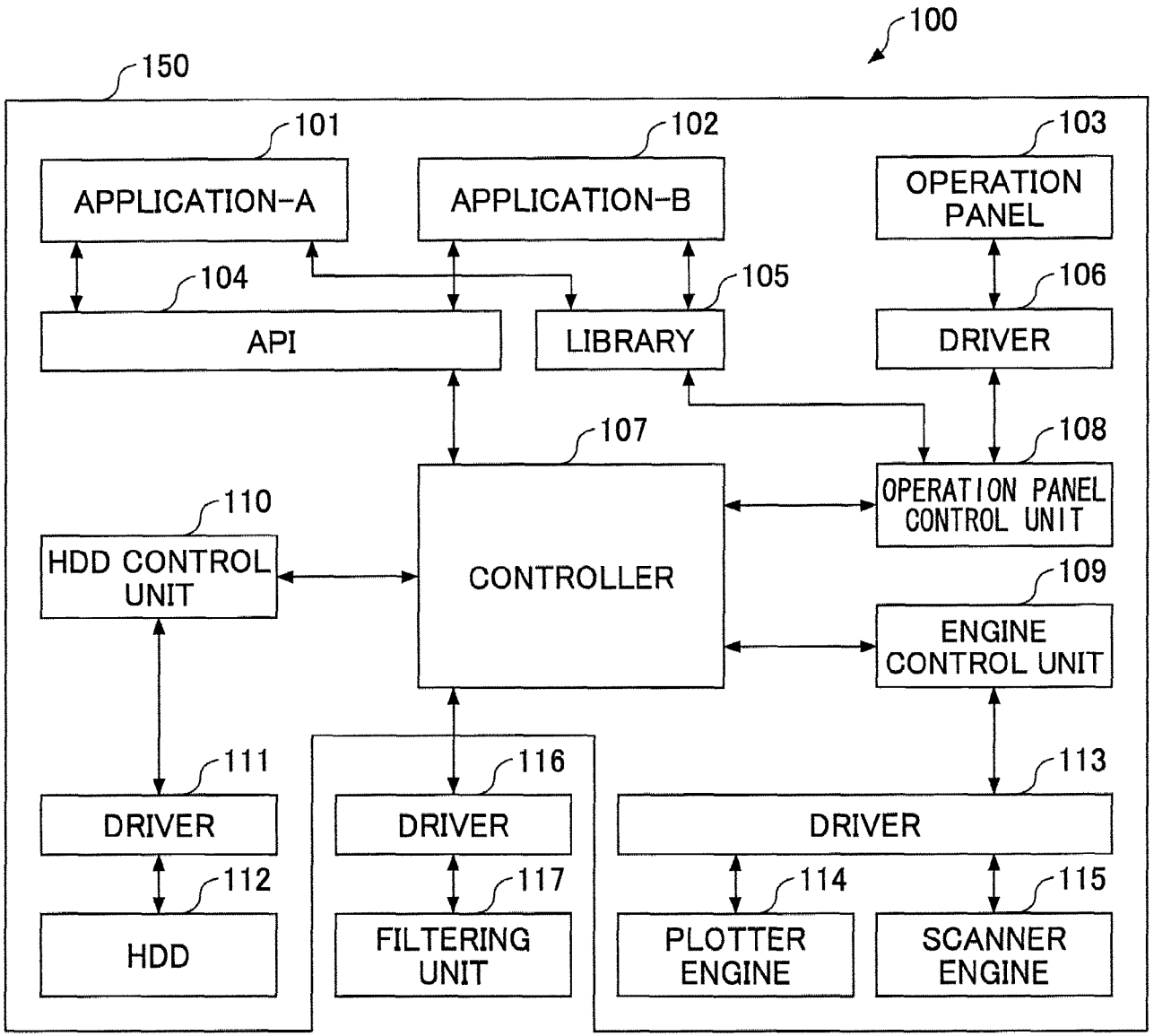
FIG. 1 is a block diagram showing the composition of an image forming device in an embodiment of the invention.

FIG. 1 is a block diagram showing the composition of an image forming device in an embodiment of the invention. The image forming device 100 of FIG. 1 is a multi-functional peripheral (MFP) which is provided with multiple image-forming functions including a print function, a scan function, a facsimile function, and a copy function, and is capable of performing a selected one of the multiple image-forming functions according to a request received from a user.

As shown in FIG. 1, the image forming device 100 is provided with a main control function unit 150 which includes a controller 107 which controls the whole image forming device 100.

The image forming device 100 of FIG. 1 is provided with a plurality of application programs for realizing a plurality of image formation functions respectively. In the example of FIG. 1, an application-A 101 and an application-B 102 are illustrated as representative application programs of the plurality of application programs. Each of the application-A 101 and the application-B 102 communicates with the controller 107 through an API (application programming interface) 104, and transmits and receives a variety of information items.

A HDD (hard disk drive) 112 is provided in the image forming device 100 of FIG. 1 as a storage device. The HDD 112 is controlled by a HDD control unit 110 through a driver 111.

A plotter engine 114 and a scanner engine 115 are provided as a unit which realizes the print function for printing an image and a unit which realizes the scan function for reading an image respectively. The plotter engine 114 and the scanner engine 115 are controlled by an engine control unit 109 through a driver 113.

An operation panel 103 which is used by a user is provided in the image forming device 100 of FIG. 1. The operation panel 103 is controlled by an operation panel control unit 108 through a driver 106. The operation panel control unit 108 is a control unit which realizes the control function of operations and displays on the operation panel 103.

The operation panel control unit 108 communicates with the controller 107, and transmits or receives information related to the displaying of the operation panel 103. Also, the operation panel control unit 108 communicates with the application-A 101 and the application-B 102 through a library 105, and transmits or receives information related to the displaying of the operation panel 103.

The controller 107 is a main control unit which controls the whole image forming device 100, and this controller 107 collectively carries out management of the power supply state of the HDD 112, management of the power supply state of the HDD control unit 110 and the engines 114 and 115, management of engine power saving state, and control of the engines 114 and 115.

The controller 107 controls the state of the operation panel 103 for displaying the operating state or the setting information of the image forming device to the user, in accordance with the operating state of the application-A 101 or the application-B 102 and the operating state of the engines 114 and 115, and controls the state of the operation panel control unit 108 which controls the operation panel 103.

A functional block of the image forming device 100 which includes the above-mentioned function units 101-115 (including the controller 107) which control the various functions of the image forming device 100 mentioned above is called the main control function unit 150.

The image forming device of FIG. 1 is provided so that, when an input operation is not performed by a user over a predetermined time or when a shifting request for shifting the image forming device to the power saving state is inputted by the user on the operation panel 103, the image forming device is shifted to the minimum power state in which the power supply to the major control functions (including the control function to stop the displaying of the operation panel 103, the control function to stop the rotation of the polygon motor, the control function to lower the fixing temperature, the control function to inhibit operation of peripheral devices, and the control function to reduce driving parts of the image forming device body, such as motors) is stopped, in order to reduce the power consumption further.

In the image forming device of FIG. 1, a filtering unit 117 is provided to receive the power supply from another power source which is separate from the power source which supplies power to the main control function unit 150. An output terminal of the filtering unit 117 is connected to the controller 107 through a driver 116. The image forming device 100 of FIG. 1 is provided with a network interface unit, such as NIC (which is not illustrated), and thus the image forming device 100 is arranged to be connectable to an external device on a network, such as LAN. An input terminal of the filtering unit 117 (which is not illustrated) is connected to the network interface unit mentioned above. In this embodiment, the filtering unit 117 and the driver 116 are set in an active state before the image forming device is shifted from the power saving state to the minimum power state.

Even in the minimum power state, the filtering unit 117 continuously receives the power supply and it is held in the active state. The filtering unit 117 has a function to monitor communication between the image forming device 100 and an external device at any time.

When a communication signal (packet) in a predetermined communication protocol entering the filtering unit 117 is detected during the minimum power state, the filtering unit 117 notifies a return trigger for returning the image forming device from the minimum power state, to a subsystem (which is not illustrated) provided in the image forming device 100.

When the above-mentioned subsystem receives this return trigger and it is determined that the received trigger satisfies the predetermined return conditions, the power supply to the controller 107 and/or the engine control unit 109 is restarted through the control of a power supply control unit (which will be mentioned later), in order to return the image forming device 100 from the minimum power state. Then, the controller 107 restarts the power supply to the HDD control unit 110 and the operation panel control unit 108 through the control of the power supply control unit.

A response/monitoring task of the above-mentioned subsystem determines the content (IO port number) of the communication signal (packet) detected by the filtering unit 117. In order to enable the image forming device 100 to return from the minimum power state according to the result of the determination, the controller 107 receives a notice of return information from the response/monitoring task, and, after this notice is received, the controller 107 causes the operating state of the image forming device 100 to be shifted to the standby state so that the image forming device 100 is ready for performing a printing operation.

The returning of the image forming device 100 from the power saving state or the minimum power state is also performed when the response/monitoring unit of the above-mentioned subsystem detects an input operation which is performed on the operation panel 103 of the image forming device 100 by the user. This return processing procedure will be mentioned later.

After the image forming device 100 of FIG. 1 is returned from the power saving state, the scanner engine 115 converts into digital image information an image of a document read in response to a document reading request, and transmits the image information to the controller 107. The controller 107 receives the image information and stores the received image information in the HDD 112 through the HDD control unit 110 when accumulation or temporary saving of the received image is required. On the other hand, when accumulation and temporary saving of the received image is not needed but printing of the received image is required, the controller 107 transmits the received image to the plotter engine 114, so that a printing operation is sequentially performed.

Figure 6:
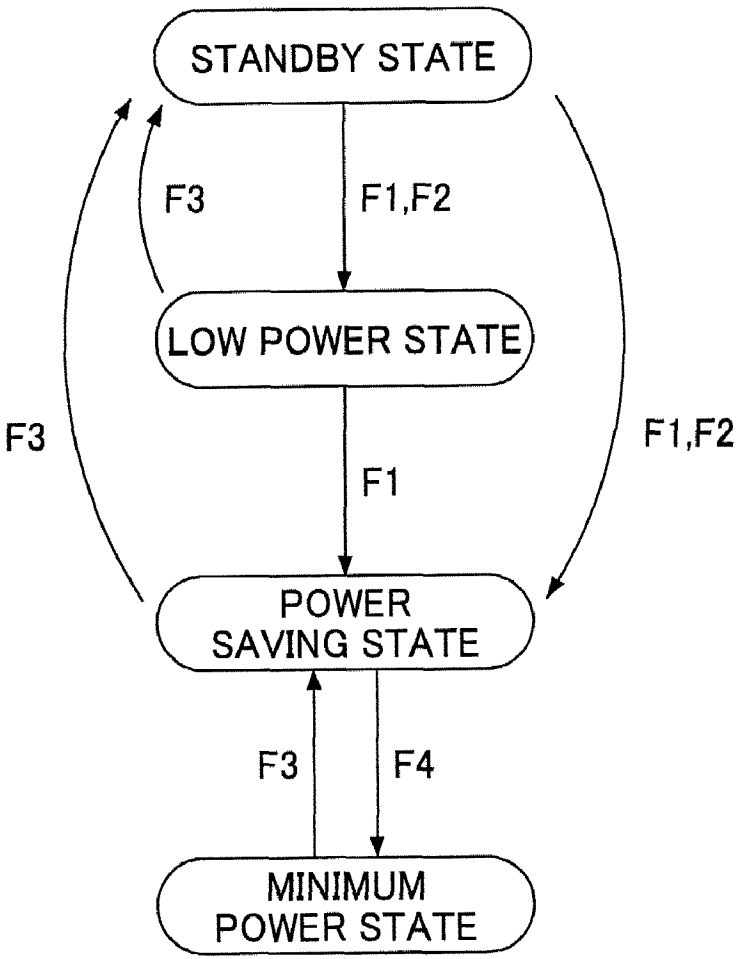
FIG. 6 is a diagram for explaining the state-transition conditions for making the operating state of the image forming device of FIG. 1 change.

FIG. 6 is a diagram for explaining the state-transition conditions for making the operating state of the image forming device of FIG. 1 change.

As shown in FIG. 6, the operating states of the image forming device 100 of FIG. 1 are classified into a standby state, a low power state, a power saving state, and a minimum power state.

The standby state in FIG. 6 is a normal operating state of the image forming device 100 in which the image forming device 100 is ready for performing an image formation operation (for example, a printing operation) in response to a request received from the user. If a state-transition factor F1 (expiration of a timer count, etc.) or a state-transition factor F2 (a key operation by a user, etc.) occurs during the standby state, the operating state of the image forming device 100 is shifted to the low power state or the power saving state.

If a state-transition factor F3 (a key operation, a network response, etc.) occurs during the low power state or the power saving state, the operating state of the image forming device 100 is returned to the standby state.

If the state-transition factor F1 (expiration of a timer count, etc.) occurs during the low power state, the operating state of the image forming device 100 is shifted to the low power saving state in which the power consumption is relatively low.

If the state-transition factor F3 (a key operation, a network response, etc.) occurs during the power saving state, the operating state of the image forming device 100 is returned to the standby state. If a state-transition factor F4 (expiration of an internal timer count, etc.) occurs during the power saving state, the operating state of the image forming device 100 is shifted to the minimum power state in which the power consumption is still lower.

On the other hand, if the state-transition factor F3 (a key operation, a network response, etc.) occurs during the minimum power state, the operating state of the image forming device 100 is returned to the power saving state or to the standby state via the power saving state. In the case where the state-transition factor F3 at this time is a printing request, the operating state of the image forming device 100 is returned from the minimum power state through the power saving state to the standby state, so that the image forming device 100 is ready for performing a printing operation.

An ASIC (which is not illustrated) in the image forming device 100 of FIG. 1 serves as the above-mentioned subsystem which performs the control of the power supply for returning the image forming device 100 from the minimum power state, in association with the filtering unit 117 and the driver 116.

The subsystem is held in the active state, together with the filtering unit 117 and the driver 116, even in the minimum power state. In other words, during the minimum power state, the power supply to all the control units (including the controller 107) of the main control function unit 150, except the power supply control unit of the subsystem (which performs the control of the power supply) and the response/monitoring unit of the subsystem (which performs the response/monitoring to an external input, such as an input operation by the user or an input received through the communication interface unit to which the external device is connected, is stopped.

The above-mentioned subsystem has a CPU provided therein. During the minimum power state, the operation of the power supply control unit and the response/monitoring unit of the above-mentioned subsystem is controlled by the software implemented as a task on the OS (operating system) in the image forming device 100 of FIG. 1.

For example, the software of the above-mentioned subsystem may include a power-supply-control task, a communication driver task, a filter task, a USB response task, an operation panel task, an input/output port task, a timer task, etc.

When the power switch of the image forming device 100 is turned on, the above-mentioned subsystem is initiated and the respective tasks of the subsystem are initialized. During the minimum power state, the above-mentioned subsystem continuously receives the power supply and is held in the active state. The response/monitoring unit continuously performs the response/monitoring operation to the external input.

Therefore, the tasks of the above-mentioned subsystem monitor the corresponding portions of the ASIC during the minimum power state. When the result of the monitoring satisfies the return conditions, the image forming device 100 is caused to return from the minimum power state through the control of the power supply control unit.

A transition shifting procedure which is performed when the operating state of the image forming device 100 of FIG. 1 is shifted from the power saving state to the minimum power state, and a return processing procedure which is performed when the operating state of the image forming device 100 of FIG. 1 is returned from the minimum power state to the power saving state will be described later with reference to FIG. 4 and FIG. 5 respectively.

Figure 2:
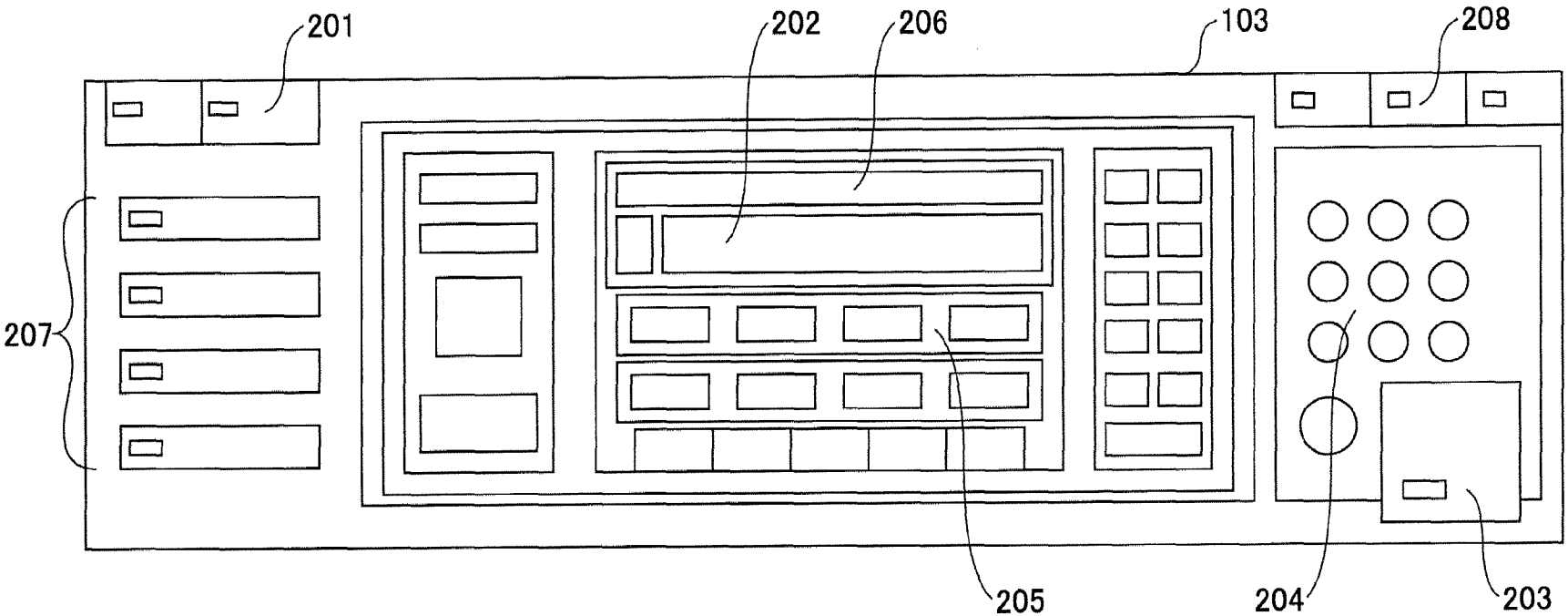
FIG. 2 is a diagram showing the composition of an operation panel in the image forming device of FIG. 1.

FIG. 2 is a diagram showing the composition of the operation panel 103 in the image forming device of FIG. 1.

When the user intends to perform a normal printing operation, the user operates ten keys 204 to set up the number of print copies. The user can operate print-mode selection keys 205 to select a desired detailed setting of operation. After this setting is performed, the user presses a start key 203 so that the corresponding application program starts running.

The information from the running application or the controller which indicates the operation situation at this time is displayed on a panel display 202 or a banner display 206 to the user. In order to change the application program, the user may press a selected one of application change keys 207 so that the current application program is switched to the selected application program. Between the application programs and the application change keys 207, one-to-one correspondence is established.

When the image forming device 100 is shifted to the power saving state, a notice of the shifting is displayed to the user according to the transition state of the power saving.

The LED of the power-saving key 208 is lit to display the power-saving transition state in which the image forming device is shifted to the power saving state. The power-saving key 208 has the function of the shift key for shifting to the power saving state.

Besides the power-saving key 208, the image forming device may be shifted to the power saving state when the time count of the timer in the controller 107 exceeds a predetermined value, or when the power key 201 of the image forming device is pressed.

Figure 3:
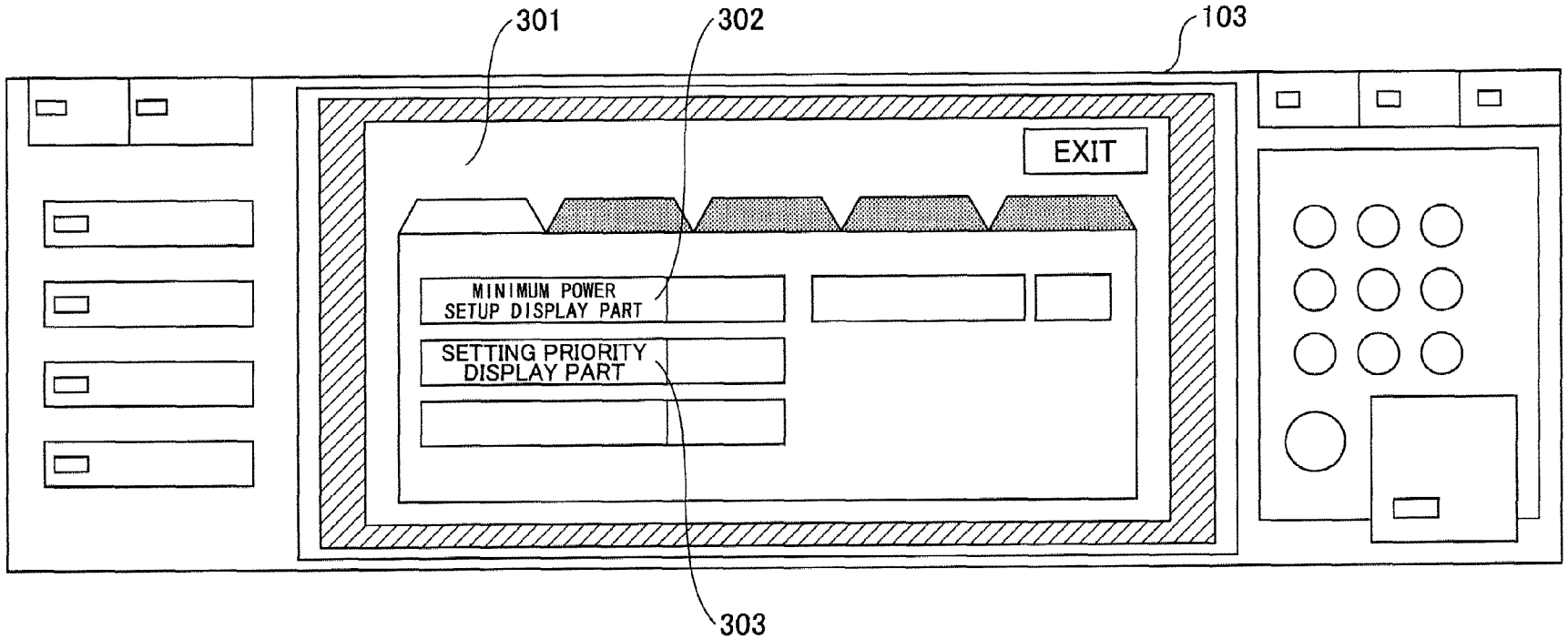
FIG. 3 is a diagram showing an example of a power-saving-operation setting screen displayed on the operation panel.

FIG. 3 is a diagram showing an example of a power-saving-operation setting screen 301 which is displayed on the operation panel 103 when the user inputs a setting of the power-saving operation of the image forming device.

As shown in FIG. 3, if the user opens the setting screen of the image forming device in the operation panel 103, various kinds of setting items which can be set up by the user are displayed for every tag of various functions of the image forming device. If the user chooses the tag of power-saving-operation setting among the tags, then the power-saving-operation setting screen 301 appears on the operation panel 103.

The user can set up various kinds of setting of the power saving operation using this power-saving setting screen 301. From a minimum power setup display part 302 of the screen 301 in the example of FIG. 3, the user can set up an operation setting as to whether shifting of the image forming device from the power saving state to the minimum power state (in which the power supply to the controller 107 is further stopped) is permitted or inhibited.

Moreover, from a setting priority display part 303 of the screen 301 in the example of FIG. 3, the user can set up an operation setting according to the need of the user as to whether the power-saving priority setting is selected or the recovery time shortening setting to shorten the power-saving recovery time by setting the connected external device in valid/invalid state is selected.

For example, when the connected external device is a wireless LAN device and the user wishes to give priority to operation of the wireless LAN device connected to the image forming device, this wireless LAN device is set in valid state and the recovery time shortening setting is selected from the setting priority display part 303 of the screen 301. In this case, shifting of the image forming device from the power saving state to the minimum power state is not performed, the image forming device is always caused to return directly from the power saving state, and the power-saving recovery time is shortened. Usually, a certain amount of standby time is needed for the image forming device to return from the minimum power state via the power saving state after the power supply to the controller 107 is stopped (refer to FIG. 6).

Similarly, when the connected external device is a USB device (a USB memory or external printer), the user can set up, from the setting priority display part 303 of the screen 301, the operation setting according to the need of the user as to whether the power-saving priority setting is selected or the recovery time shortening setting by setting the connected USB device in valid state is selected.

In the example of FIG. 3, only the two kinds of operation setting (the minimum power setup display part 302 and the setting priority display part 303) are illustrated. However, the invention is not limited to this example. Alternatively, operation setting concerning the power-saving operation other than mentioned above may also be performed.

For example, suppose that the image forming device 100 is connected to a center system at a remote place via a communication network and the image forming device has the function to communicate with the center system periodically so that the center system performs remote maintenance service of the image forming device. In this case, the user may set up an operation setting as to whether the power-saving priority setting is selected or the maintenance service priority setting is selected.

Figure 4:
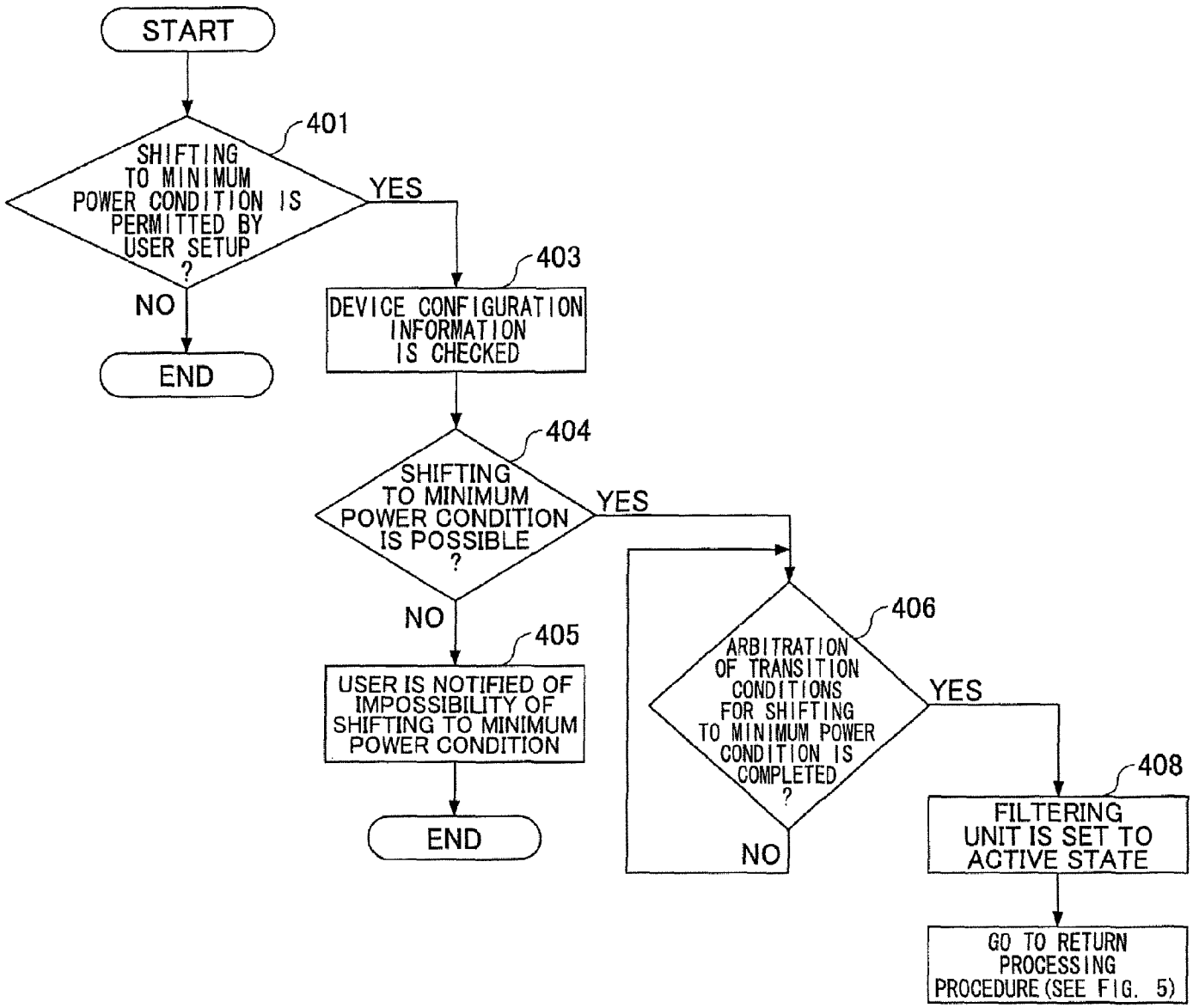
FIG. 4 is a flowchart for explaining a transition shifting procedure which is performed when the image forming device of FIG. 1 is shifted from the power saving condition to the minimum power state.

FIG. 4 is a flowchart for explaining the transition shifting procedure which is performed when the image forming device of FIG. 1 is shifted from the power saving state to the minimum power state.

The transition shifting procedure of FIG. 4 is started when a shifting request for shifting the image forming device 100 to the minimum power state arises in the image forming device 100 in the power saving state. During the power saving state, only the power supply to the controller 107 is turned ON, and the power supply to other function units of the main control function unit 150 is turned OFF. The shifting request may include a case in which the power-saving key 208 is pressed by the user, and a case in which a predetermined time is exceeded while the image forming device is not used by the user.

Upon start of the transition shifting procedure of FIG. 4, the controller 107 determines whether the user's operation setting is to permit the shifting of the image forming device 100 to the minimum power state (step 401).

The determination of step 401 is based on whether the user previously selected, from the minimum power setup display part 302 of FIG. 3, the operation setting to permit shifting of the image forming device from the power saving state to the minimum power state or not.

When the result of the determination of step 401 is negative (the shifting is inhibited) the image forming device 100 is never shifted to the minimum power state, and the transition shifting procedure of FIG. 4 is terminated immediately.

On the other hand, when the result of the determination of step 401 is affirmative (the shifting is permitted), the controller 107 performs processing to check the configuration information of the image forming device 100 and the state of the external device connected to the image forming device 100 (step 403).

Based on the result of checking of the configuration information of the image forming device 100 and the state of the connected external device, the controller 107 determines whether shifting of the image forming device from the power saving state to the minimum power state (in which the power supply to the controller 107 is stopped further) is possible (step 404).

For example, suppose the case in which the configuration information of the image forming device 100 indicates that a certain device (a wireless LAN device, a USB device, etc.) which requires periodical communication with the exterior is connected to the image forming device 100. In this case, even if the image forming device 100 is shifted to the minimum power state, it will be necessary to immediately return from the minimum power state via the power saving state.

If the shifting to the minimum power state should be permitted in this case, it will become a factor which worsens the machine life of the image forming device because that device causes the image forming device to repeat periodically operations for shifting from the power saving state to the minimum power state, and for returning from the minimum power state to the power saving state or the standby state conversely.

To avoid this, it is desirable for this embodiment to give priority to the effect of maintaining the machine life of the image forming device over a long period of time rather than the effect of reduction of the power consumption by the shifting to the minimum power state. Therefore, when a certain device (a wireless LAN device, a USB device, etc.) which requires periodical communication with the exterior is connected, the result of the determination of step 404 is considered as an operation setting which inhibits shifting of the image forming device 100 to the minimum power state (the shifting to the minimum power state is impossible).

When the result of the determination of step 404 indicates that the shifting to the minimum power state is impossible, the controller 107 notifies the user of impossibility of the shifting to the minimum power condition (step 405). And the transition shifting procedure of FIG. 4 is terminated.

The method of notifying the user of the impossibility of the shifting to the minimum power condition in step 405 may include a method of notifying a device administrator of the impossibility by e-mail, a method of outputting an alarm sound to receive attention from the user, a method of displaying an alarm message on the screen of the operation panel 103, etc. Thereby, the user or the device administrator is able to take a necessary action to avoid the factor to make the shifting to the minimum power state impossible.

On the other hand, when the result of the determination of step 404 indicates that the shifting to the minimum power condition is possible, the controller 107 arbitrates the transition conditions for shifting to the minimum power state, by comparison with the operating state of each program of the application layer or the service layer of the image forming device 100, and determines whether the arbitration of the transition conditions is completed (step 406).

For example, suppose the case in which the application-A 101 is operating in the image forming device 100 as a facsimile application program and sets up reservation of transmission of image data at the end of a sleep period of a given time. In this case, it is necessary for the image forming device 100 to defer the shifting to the minimum power state until the image-data transmission by the application-A 101 is completed.

Thus, the controller 107 determines at step 406 whether the arbitration of the transition conditions by comparison with the operating state of each program of the application layer or the service layer of the image forming device 100 is completed. When the arbitration with the operating state of each program of the application layer or service layer of the image forming device 100 is not yet completed, the controller 107 performs again the determination of step 406 after a predetermined time. The above-mentioned determination of step 406 is repeated until the arbitration of the transition conditions is completed.

When the result of determination of step 406 indicates that the arbitration of the transition conditions for shifting to the minimum power state is completed, the controller 107 sets the filtering unit 117 and the driver 116 to the active state (activation), and performs the preparation for shifting the image forming device 100 to the minimum power state (step 408).

Subsequently, the image forming device 100 is shifted from the power saving state to the minimum power state (in which the power supply to the controller 107 is stopped further) while the filtering unit 117 and the driver 116 are set in the active state.

As mentioned above, the subsystem of the image forming device 100 in this state monitors and detects whether the state-transition factor F3 of FIG. 6 occurs, in association with the filtering unit 117 and the driver 116.

Figure 5:
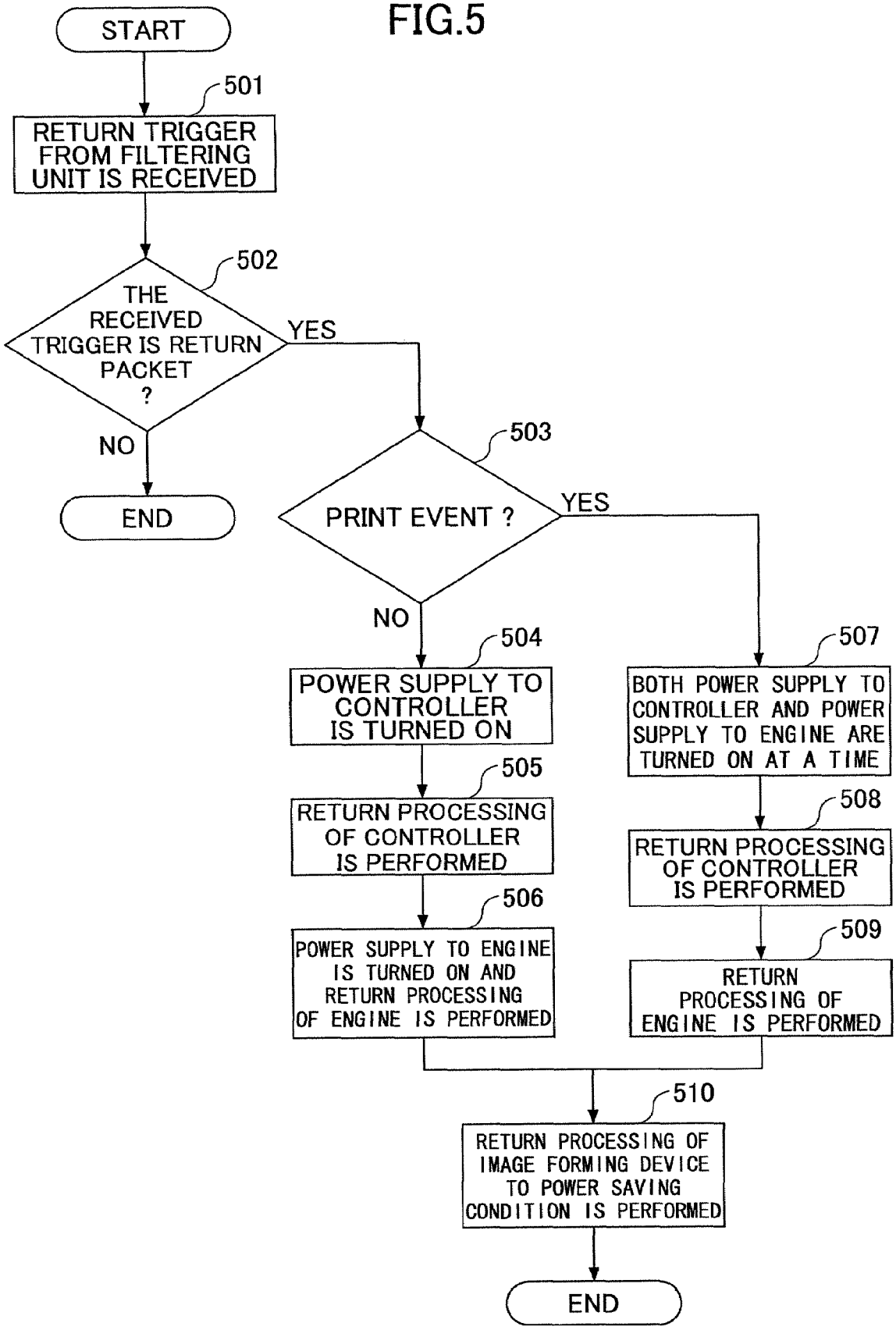
FIG. 5 is a flowchart for explaining a return processing procedure which is performed when the image forming device of FIG. 1 in the minimum power state is returned to the power saving condition.

FIG. 5 is a flowchart for explaining the return processing procedure which is performed when the image forming device of FIG. 1 in the minimum power state is returned to the power saving state or the standby state.

In the return processing procedure of FIG. 5, if a communication signal (packet) in the predetermined communication protocol entering the filtering unit 117 is detected during the minimum power state, the filtering unit 117 notifies a return trigger to the subsystem of the image forming device 100.

The subsystem receives the return trigger from the filtering unit 117 (step 501). The subsystem determines whether the return trigger received from the filtering unit 117 is a return packet in the predetermined communication protocol which satisfies the return conditions from the minimum power state (step 502).

When the result of the determination of step 502 indicates that it is not a packet in the predetermined communication protocol, the image forming device 100 should not be returned from the minimum power state. In this case, the return processing procedure of FIG. 5 is terminated immediately.

On the other hand, when the result of the determination of step 502 indicates that it is a return packet in the predetermined communication protocol, the subsystem determines whether the packet detected by the filtering unit 117 includes an image-formation request (print event) sent to the image forming device 100 from an external device, based on the IO port number obtained from the header of the packet (step 503).

In this embodiment, an IO port number in the image forming device 100 assigned for the case where the packet detected by the filtering unit 117 includes a print event is different from an IO port number assigned for the case where the detected packet includes another network event. Therefore, the subsystem can carry out the determination of step 503 based on the IO port number obtained from the header of the detected packet.

When the result of the determination of step 503 indicates that the packet does not include a print event, it is adequate to perform a responding operation (network response) to the packet only, and it is not necessary to perform immediate image-formation operation in the image forming device 100. Thus, in this case, the subsystem restarts the power supply to the controller 107 (turning the power supply ON). And the subsystem performs the return processing of the controller 107. After the return processing of the controller 107 is performed, the controller 107 restarts the power supply to the engine control unit 109 or the engines 114-115 (turning the power supply ON). And the controller 107 performs the return processing of the engine control unit 109 or the engines 114-115 (steps 503-506). Therefore, the power consumption in this case can be reduced to a comparatively low level.

On the other hand, when the result of the determination of step 503 indicates that the packet includes a print event, it is necessary to perform immediate image-formation operation in the image forming device 100. In this case, the subsystem restarts the power supply to the controller 107 and the power supply to the engine control unit 109 simultaneously (turning the power supply ON). And the subsystem performs the return processing of the controller 107. After the return processing of the controller 107 is performed, the controller 107 performs the return processing of the engine control unit 109 or the engines 114-115 (steps 507-509). Therefore, in this case, while the time to arrive at the image-formation permitted state is shortened comparatively, the power consumption becomes comparatively high.

Subsequently, the controller 107 performs the return processing of the image forming device 100 to a power-saving condition according to the contents of the packet detected by the filtering unit 117 (step 510).

For example, when the packet includes a print event, the controller 107 performs the return processing of the HDD control unit 110, the operation panel control unit 108, and the operation panel 103 in this order, so that the image forming device 100 is returned to the standby state in which the image forming device 100 is ready for performing a printing operation. After the return processing is completed, the return processing procedure of FIG. 5 is terminated.

As mentioned above, when the user's input operation occurs on the operation panel 103 of the image forming device 100 in the minimum power state, the above-mentioned subsystem and the controller 107 perform the return processing so that the image forming device 100 is returned from the minimum power state.

The respective processing in the above-mentioned embodiment may be realized by using a computer-readable recording medium having program code stored thereon. When executed by a CPU provided in the image forming device of the invention, the recording medium causes the CPU to perform the respective processing in the above-mentioned embodiment. The recording medium may include FD, CD-ROM, and DVD, and the program code being stored on the recording medium may be offered by digital information transmitted via a network.

Provided in the image forming device of the above-mentioned embodiment are a mechanism for shifting the image forming device from the power saving state in which the power supply to all function units in the main control function unit except the main control unit is stopped, to the minimum power state in which the power supply to the main control unit is further stopped, and a mechanism for detecting a return factor during the minimum power state and for returning the image forming device from the minimum power state to the power saving state upon detection of the return factor. Therefore, it is possible to provide the power-saving control method and the image forming device which can increase the power saving effect further.

In the above-mentioned embodiment, it is determined whether shifting of the image forming device to the minimum power state in which stops the power supply to the main control unit (the controller 107) is permitted, based on the configuration information of the image forming device and the state of the external device connected. Therefore, the image forming device can be maintained in the minimum power state as desired by the user, without requiring the user to perform a detailed setting about power saving.

In the above-mentioned embodiment, the reception of an e-mail containing an alarm message enables the user to know the impossibility of shifting of the image forming device to the minimum power state, and this enables the user to take a necessary action to avoid the factor to make the shifting to the minimum power state impossible.

In the above-mentioned embodiment, an alarm message indicating the impossibility of shifting of the image forming device to the minimum power condition can be displayed on the operation panel to receive attention from the user, and this enables the user to take a necessary action to avoid the factor to make the shifting to the minimum power state impossible.

In the above-mentioned embodiment, the user is able to set up an operation setting for permitting or inhibiting shifting of the image forming device to the minimum power state in which the power supply to the main control unit is stopped further, and increased convenience can be provided for the user.

The present invention is not limited to the above-described embodiments, and variations and modifications may be made without departing from the scope of the present invention.

The present application is based on and claims the benefit of priority of Japanese patent application No. 2006-135635, filed on May 15, 2006, and Japanese patent application No. 2007-084986, filed on Mar. 28, 2007, the entire contents of which are hereby incorporated by reference.

What is claimed is:

1. A power-saving control method of an image forming device which is adapted for being set in a power saving state in which power supply to all function units in a main control function unit, except a main control unit which controls the whole image forming device, is stopped, comprising steps of:

setting the image forming device in the power saving state when an input operation is not performed by a user over a predetermined time;

shifting the image forming device from the power saving state to a minimum power state in which power supply to the main control unit is stopped;

activating, prior to shifting of the image forming device to the minimum power state, a filtering unit receiving a power supply separate from a power supply to the main control function unit, so that the filtering unit detects communication between an external device and the image forming device in the minimum power state;

determining whether a communication signal detected by the filtering unit in the minimum power state indicates an image formation request from the external device; and causing, when the communication signal indicates the image formation request, the image forming device to return from the minimum power state through the power saving state to a standby state, so that the image forming device is ready for performing image formation.

2. The power-saving control method according to claim 1, wherein the step of shifting the image forming device includes a step of determining whether shifting of the image forming device to the minimum power state is permitted based on configuration information of the image forming device and a state of the external device connected to the image forming device.

3. The power-saving control method according to claim 1, further comprising a step of notifying the user of impossibility of shifting of the image forming device to the minimum power state by e-mail, when it is determined that the shifting of the image forming device is not permitted.

4. The power-saving control method according to claim 1, further comprising a step of displaying an alarm message, indicating that shifting of the image forming device to the minimum power state is impossible, on an operation panel of the image forming device to receive attention from the user, when it is determined that the shifting of the image forming device is not permitted.

5. The power-saving control method according to claim 1, wherein the step of shifting the image forming device includes a step of determining whether an operation setting for permitting shifting of the image forming device to the minimum power state is performed beforehand on a setting screen of an operation panel of the image forming device by the user.

6. The power-saving control method according to claim 1, wherein the step of shifting the image forming device includes a step of arbitrating transition conditions for shifting to the minimum power state by comparison with an operating state of a program of an application layer of the image forming device, and determining whether arbitration of the transition conditions is completed.

7. An image forming device which is adapted for being set in a power saving state in which power supply to all function units in a main control function unit, except a main control unit which controls the whole image forming device, is stopped, comprising:

a setting unit setting the image forming device in the power saving state when an input operation is not performed by a user over a predetermined time;

a shifting unit shifting the image forming device in the power saving state to a minimum power state in which power supply to the main control unit is stopped;

a filtering unit receiving a power supply separate from a power supply to the main control function unit, and detecting communication between an external device and the image forming device in the minimum power state;

an activating unit activating, prior to shifting of the image forming device to the minimum power state, the filtering unit, so that the filtering unit detects communication between the external device and the image forming device in the minimum power state;

a determining unit determining whether a communication signal detected by the filtering unit in the minimum power state indicates an image formation request from the external device; and a returning unit causing, when the communication signal indicates the image formation request, the image forming device to return from the minimum power state through the power saving state to a standby state, so that the image forming device is ready for performing image formation.

8. The image forming device according to claim 7, wherein the shifting unit includes a determining unit determining whether shifting of the image forming device to the minimum power state is permitted based on configuration information of the image forming device and a state of the external device connected to the image forming device.

9. The image forming device according to claim 7, further comprising a notifying unit notifying the user of impossibility of shifting of the image forming device to the minimum power state by e-mail, when it is determined that the shifting of the image forming device is not permitted.

10. The image forming device according to claim 7, further comprising a displaying unit displaying an alarm message, indicating that shifting of the image forming device to the minimum power state is impossible, on an operation panel of the image forming device to receive attention from the user, when it is determined that the shifting of the image forming device is not permitted.

11. The image forming device according to claim 7, wherein the shifting unit includes a determining unit determining whether an operation setting for permitting shifting of the image forming device to the minimum power state is performed beforehand on a setting screen of an operation panel of the image forming device by the user.

12. The image forming device according to claim 7, wherein the shifting unit includes an arbitrating unit arbitrating transition conditions for shifting to the minimum power state by comparison with an operating state of a program of an application layer of the image forming device, and determining whether arbitration of the transition conditions is completed.

* * * * *